United States Patent [19]

Zent

[11] 3,991,749

[45] Nov. 16, 1976

[54] EXERCISING APPARATUS

[76] Inventor: Lawson J. Zent, 1818 Dean St., Huntington, Ind. 46750

[22] Filed: Nov. 17, 1975

[21] Appl. No.: 632,455

[52] U.S. Cl. ..... 128/25 R; 128/26

[51] Int. Cl.[2] ..... A61H 1/02

[58] Field of Search ..... 128/24 R, 25 R, 33, 128/25 B, 26; 272/73

[56] References Cited

UNITED STATES PATENTS

| | | | |
|---|---|---|---|
| 1,909,002 | 5/1933 | Oehlberg | 128/25 R |
| 2,020,992 | 11/1935 | Caplan | 128/25 R |
| 3,213,852 | 10/1965 | Zent | 128/25 R |
| 3,216,722 | 11/1965 | Odom | 128/25 R |

*Primary Examiner*—Lawrence W. Trapp
*Attorney, Agent, or Firm*—Albert L. Jeffers

[57] ABSTRACT

An exercising apparatus having rotatable foot pedals and hand graspable crank arms in a frame which is provided with a seat upon which an individual can be supported while grasping the crank arms and while having the feet on the foot pedals of the apparatus. A motor is provided for driving the foot pedals and crank arms in rotation, and is so connected thereto that the individual crank arms and individual foot pedals can rotate at respective speeds and, furthermore, so that the crank arm and foot pedal on one side of the machine can rotate in a direction opposite to those on the other side of the machine. The apparatus includes a control for varying the speed of rotation of the foot pedals and crank arms and also includes an emergency stop switch that can be operated by the individual for halting the apparatus.

16 Claims, 9 Drawing Figures

EXERCISING APPARATUS

The present invention relates to an exercising apparatus and, in particular, represents an improvement over the exercising apparatus of my prior U.S. Pat. No. 3,213,852 issued Oct. 26, 1965.

In the exercising apparatus of my earlier issued patent, a frame is provided having a set portion on which an individual can be seated with foot pedals and crank arms being provided in the frame engageable by the feet and hands, respectively, of the individual seated on the seat. A drive motor is provided for causing the foot pedals and crank arms to rotate and the connections of the drive motors thereto are so selected that each of the foot pedals and crank arms will rotate at a respective speed of rotation.

The exercising apparatus of my earlier patent is highly useful but is lacking in providing the ultimate in exercising for the reason that the foot pedals and crank arms always rotate in one and the same direction even though at differential speeds.

A primary object of the present invention is the construction of an exercising apparatus of the general nature described above which provides for extensive exercising of the individual using the exercising apparatus.

A particular object of the present invention is the provision of an exercising apparatus of the nature referred to above which includes rotatable foot pedals and hand graspable rotatable crank arms in which the direction of rotation of the foot pedal and crank arm on one side of the machine can be caused to be the reverse of those on the other side of the machine, while the direction of rotation of the foot pedals and crank arms can be selectively reversed.

Still another object of the invention of the present invention is the provision of an exercising device of the nature referred to above in which the speed of rotation of the foot pedals and crank arms can be varied widely.

Still another object of the invention of the present invention is the provision of a conveniently located emergency switch on the apparatus so that the individual utilizing the apparatus can quickly shut the apparatus off.

A still other object of the invention of the present invention is the provision of an exercising apparatus of the nature referred to which can be placed selectively under the control of a therapist and removed from the control of the individual being exercised by the apparatus, except for the aforementioned emergency shut off.

BRIEF DESCRIPTION OF THE INVENTION

An exercising apparatus according to the present invention comprises a frame having a base portion for supporting the apparatus on a floor surface, and which frame includes an upright portion on which a seat is mounted. Forwardly at the seat, the frame includes another upright portion and rotatable on the last mentioned upright near the bottom are foot pedals engagable by the feet of an individual on the seat, while, near the top, are rotatable crank arms which can be grasped by the hands of an individual on the seat of the apparatus.

The foot pedals are rotatable individually and the crank arms are likewise rotatable individually and interconnecting drive means, such as chains, drivingly connect each crank arm with the foot pedal on the same side of the machine. The interconnecting drive means provides for respective speeds of rotation of the foot pedals and crank arms and likewise individual speeds of rotation of the respective foot pedals relative to each other and of the respective crank arms relative to each other. A drive motor in the frame is connected to drive the foot pedals and can be so connected to the foot pedals that one rotates in one direction, while the other rotates in the opposite direction.

The drive motor for driving the foot pedals is reversible so that the direction of rotation of the foot pedals and crank arms can be reversed at will.

The controls for the apparatus include an 'on-off' switch, which includes means for controlling the direction of rotation of the drive motor. The controls also include a control for adjusting the speed of the motor. The controls are mounted in a control box at the upper end of the frame and can be positioned on the frame to face the individual seated on the seat of the frame, or the control box can be reversed so that the controls face away from the individual being exercised and are then positioned to be actuated by a therapist. An emergency switch is also provided on the apparatus which can be actuated by the individual being exercised to shut the machine off at any time.

The nature of the present invention and several objects and advantages thereof will become apparent upon reference to the following detailed specification taken in connection with the accompanying drawings, in which.

Figure 8:
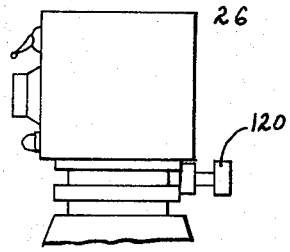
FIG. 8 is a schematic view showing one way in which the control box at the upper end of the machine frame could be reversibly supported thereon.

DETAILED DESCRIPTION OF THE INVENTION:

Referring to the drawings somewhat more in detail, the exercising apparatus of the present invention comprises a frame 10, having a vertical tubular column 12 near one end which supports a seat 14, while near the other end is an upright inwardly tapering box-like enclosure 16 within which the drive motor of the apparatus is mounted. Near the lower end of the apparatus and forwardly from seat 14 are the foot pedals 18 and 20, while near the upper portion of the apparatus and also forwardly of the seat are the hand graspable crank arms 22 and 24.

A control box 26 is mounted on the upper end of the apparatus for controlling the drive motor of the apparatus, while immediately forwardly of seat 14 is an emergency stop switch 28 which is available to the individual being exercised for turning the machine on and off.

Figure 2:
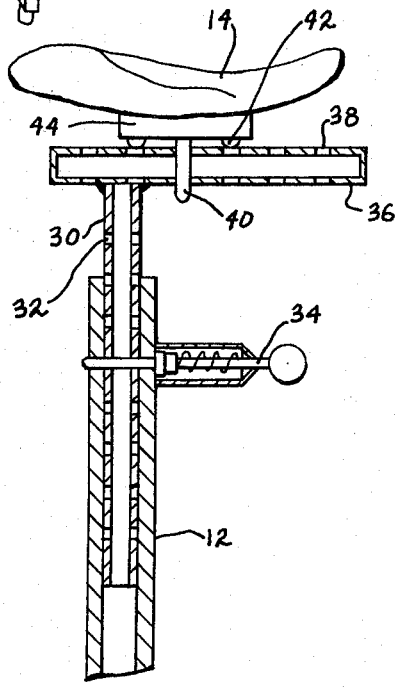
FIG. 2 is a fragmentary vertical sectional view, drawn at somewhat enlarged scale and indicated by cutting plan II—II on FIG. 1, and illustrating details and adjustable seat structure employed in the apparatus.

The seat supporting arrangement is more fully illustrated in FIG. 2 and will be seen to comprise a rod, or post, 30 slidably receivable in tubular column 12 and provided with logitudinally distributed apertures 32. Column 12 mounts a spring loaded draw bolt 34 which is receivable in apertures 32 so that rod, or post, 30 can be vertically adjusted on the frame of the machine and locked in a respective adjusted position.

Furthermore, post 30 can be rotated 180 degrees and be supported in column 12 in the same manner. At the upper end of post 30 is a horizontal tubular cross bar 36 having apertures 38 extending therethrough the vertical direction and spaced therealong. Apertures 38 are adapted for receiving the center post 30 on the seat 14 and one or both of the locating studs 42 extending downwardly from member 44 which is fixed to the underside of the seat. At this point, it will be ssen that the seat 14 is adjustable over a wide range in the fore and aft direction, while the post 30 and the bar 36 connected thereto is adjustable vertically in tubular column 12 and is also reversible therein to provide for a still greater amount of adjustment of seat 14 in the fore and aft direction.

Figure 3:
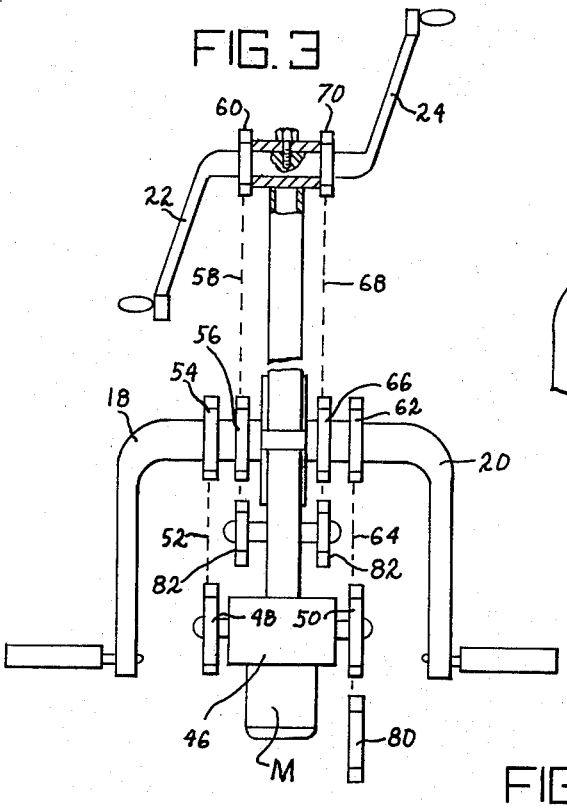
FIG. 3 is a diagrammatic view showing the interconnection of the hand grips with the foot pedals and also showing how the foot pedals are driven.
Figure 4:
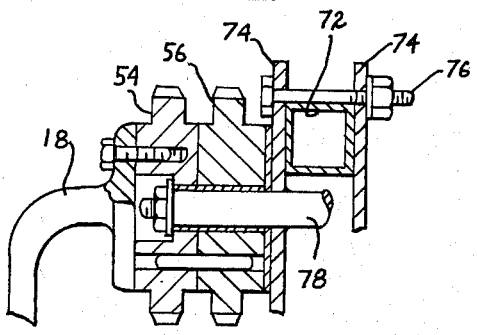
FIG. 4 is a fragmentary sectional view indicated by line IV—IV on FIG. 3, showing how the foot pedals of the apparatus are supported thereon for independant rotation.
Figure 5:
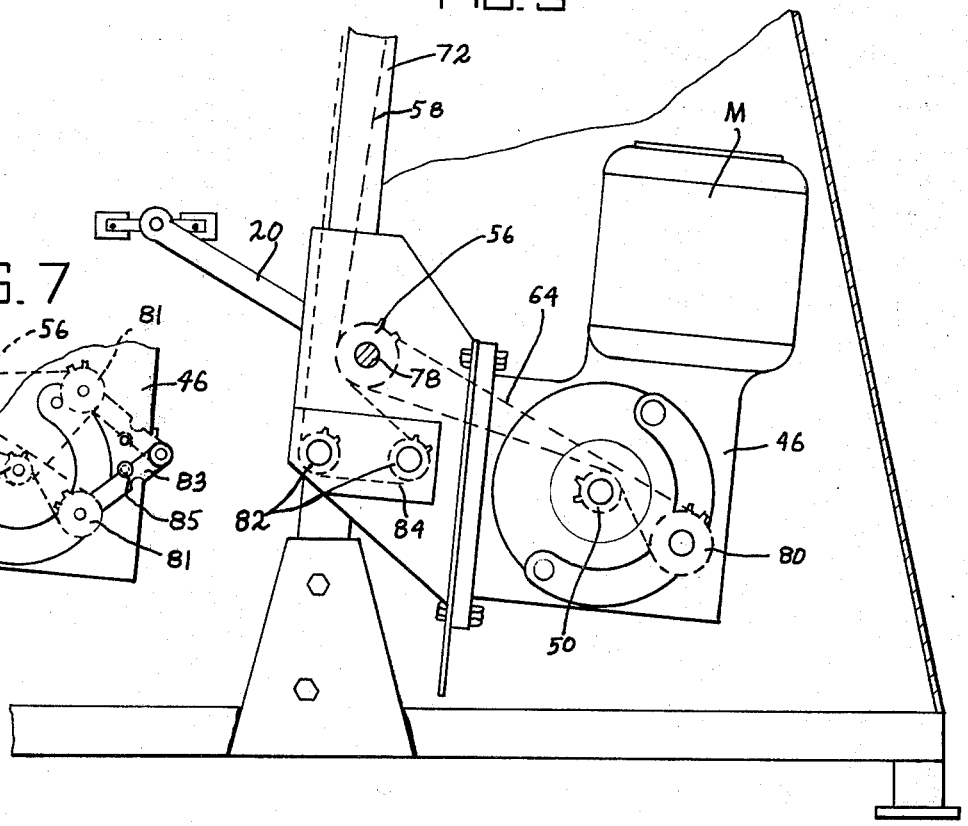
FIG. 5 is a fragmentary side view showing somewhat more in detail the drive for the foot pedals and crank arms.

Turning now to FIGS. 3, 4 and 5, the drive for the foot pedals and crank arms is illustrated.

Figure 1:
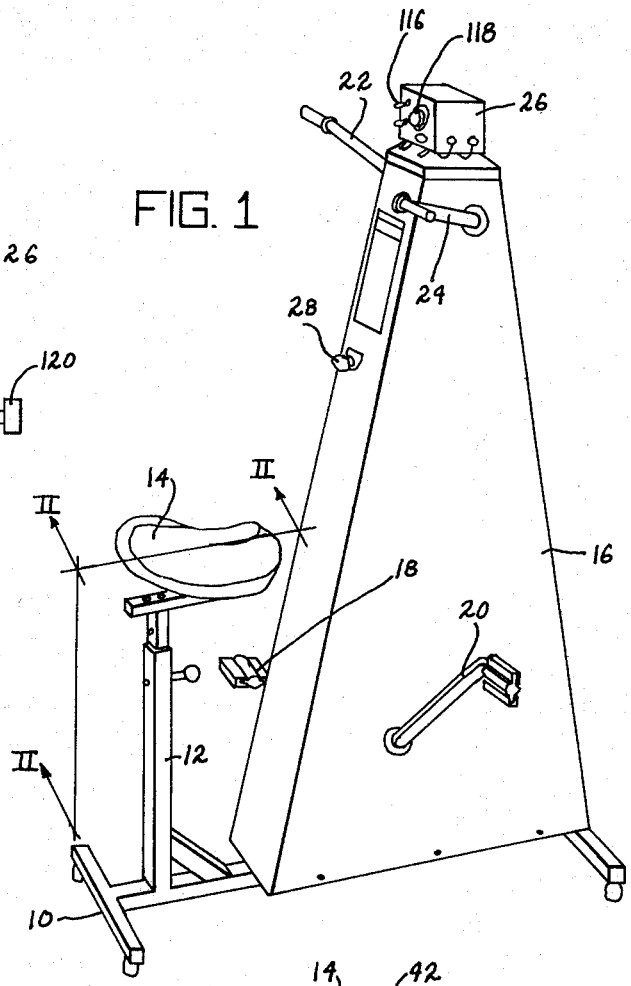
FIG. 1 is a perspective view, somewhat schematic, showing an exercising apparatus according to the present invention.

Turning first to FIG. 3, a motor M, mounted in the frame, has speed reducing means at 46 driven thereby and which speed reducing means drives individual sprockets 48 and 50. The sprocket 48, which is on the rearward side of the apparatus, as it is viewed in FIG. 1, is connected by chain 52 with a sprocket 54 which is drivingly connected to foot pedal 18. Also fixedly connected to sprocket 54 is a further sprocket 56 which is connected by chain 58 with a sprocket 60 connected to crank arm 22. The sprockets 56 and 60 are preferably of different sizes so that when foot pedal 18 is driven, crank arm 22 and foot pedal 18 will rotate at respectively different speeds.

The same drive arrangement is provided in respect of foot pedal 20 and crank arm 24 by the sprocket 62 on foot pedal 20 which is connected to motor driven sprocket 50 by chain 64, while a second sprocket 66 connected to sprocket 62 is connected by chain 68 to sprocket 70 on crank arm 24. Sprockets 66 and 70 are also of different size so that the speed of rotation of foot pedal 20 is different from the speed of rotation of crank arm 24.

The individual drives to the respective foot pedals are also advantageously of different drive ratio and each foot pedal is individually rotatably supported in the frame, as will be seen in FIG. 4. In FIG. 4, the frame will be seen to comprise an upright tubular member 72 of substantial size, with the frame work consisting of plates 74 connected thereto as by bolt means 76. A shaft 78 supported by the frame supports the foot pedals having the sprockets mounted thereon for individual rotation.

The chain which connects sprockets 50 and 62 is arranged, as seen in FIG. 5, to engage motor driven sprocket 50 on the back of the chain, while an idler sprocket 80 is provided about which the chain is also entrained. By the provision of the idler sprocket 80, the foot pedal 20 is caused to rotate in the direction opposite to the direction of rotation of foot pedal 18. Alternatively, the chain 64, instead of engaging sprocket 50 by the back of the chain, could be entrained directly thereabout as shown in FIG. 6 and, in which case, foot pedal 20 would rotate in the same direction as foot pedal 18 although, preferably, at a respective speed of rotation.

Each of chains 58 and 68 is arranged in the same manner and FIG. 5 shows the manner in which chain 58 is arranged for engagement with sprocket 56. The chain 58 is entrained over sprocket 68, while sprocket 56 engages the back of the chain. A pair of idler sprockets 82 mounted on the support plate 84 are provided and about which the chain is entrained. By arranging the chains 58 and 68 in the manner illustrated in FIG. 5 each crank arm 22, 24 is caused to rotate in the direction opposite to the direction of rotation of the respective foot pedal 18, 20.

Figure 6:
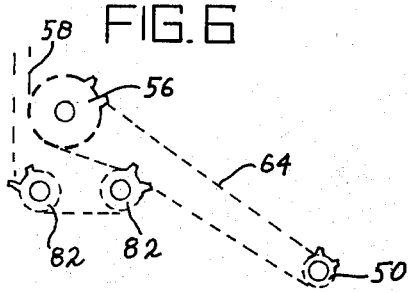
FIG. 6 is a schematic view showing how the direction of rotation of the foot pedal and crank arm on one side of the machine could be changed relative to what is shown in FIG. 5.
Figure 7:
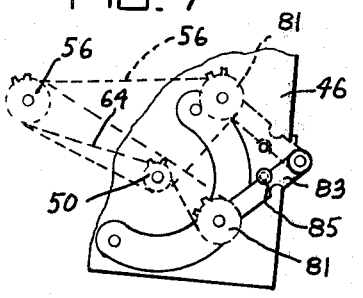
FIG. 7 is a schematic view showing an arrangement for changing the drive from its FIG. 5 to its FIG. 6 configuration, while utilizing one and the same drive chain.

In changing from the FIG. 5 drive arrangement to the FIG. 6 drive arrangement, a change in length of chain 64 is necessary, but there is shown an arrangement in FIG. 7 in which the idler sprocket 81, and will corresponds to idler sprocket 80 in FIG. 5 is mounted on a swingable arm 83 which can be moved from its full line position to its dotted line position, and the same chain 64 can be utilized in both positions of idler sprocket 81 but with the chain being driven in a respective direction in each of the positions of the idler sprocket because the chain engages the motor sprocket 50 in a respective manner in each position of the idler sprocket. Different devices can be employed for supporting the arm 83 in each of its positions, and there is illustrated in FIG. 7 a pin 85 that will hold the arm in either of its adjusted positions and which can be withdrawn to permit movement of the arm.

With the FIG. 7 arrangement, in order to change from one direction of rotation to the other of the respective foot pedal, pin 85 is withdrawn and, whereupon, arm 83 and sprocket 81 can be moved to relax chain 64, which can then be adjusted from one side of sprocket 50 to the other side. The arm 83 and sprocket 81 are then moved to the other position thereof and locked in place and the apparatus can then be restarted.

Figure 9:
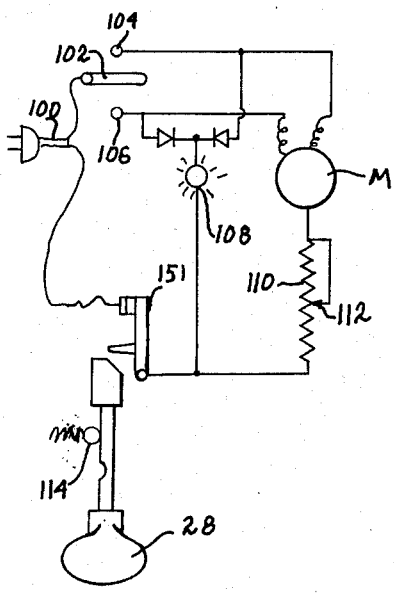
FIG. 9 is a schematic illustration of a typical electric control circuit which could be employed in respect of controlling the drive motor of the machine.

FIG. 9 shows a typical electric circuit which can be utilized for controlling drive motor M. In FIG. 9, the electric cord 100 can be connected to a suitable outlet with one side of the line being connected to a switch blade 102 which has an 'off' position in which it is shown and also having a 'forward' position in which it engages terminal 104, and a 'reverse' position in which it engages terminal 106. The motor M will run in a respective direction for each of the last two mentioned positions of switch blade 102.

A condition of energization of motor M can be indicated by a single lamp 108 which is connected to the lines leading from terminals 104 and 106 by respective diodes with the other side of the lamp being connected to the line on the other side of motor M. In series with motor M is a rheostat 110 having an adjustable slider 112 which is removable for varying the speed of rotation of motor M.

The switch 28 previously referred to, and positioned for actuation by the individual utilizing the machine, will be seen to include a limit switch LS1 which is biased toward closed position but which will open when the knob of switch 28 is pushed inwardly and thereby interrupt the energizing circuit for motor M. Swith 28 may include detent means 114 for releasably retaining the switch knob in each of its 'switch open' and 'switch closed' positions.

The 'on-off' reversing switch consisting of switch arm 102 and terminals 104 and 106 is mounted in control box 26 as indicated at 116. Furthermore, the rheostat 110 and the slider 112 is also mounted within the control box as indicated at 118. The control box 26 is mounted on the upper part of portion 16 of the frame so that the control box can be positioned to face the individual seated on seat 14 or so that it can face away from the individual. To this end, as shown in FIG. 8, the control box 26 may have a telescoping connection with a sleeve upstanding from the top of portion 16 of the frame and to be rotatable thereon and adapted for being clamped in position by a clamp screw 120. Alternatively, the control box can merely be lifted and turned to the desired position and then set back down on the top of portion 16 of the machine frame. The movability of control box 16 offers the advantage that it can be placed under the control of a therapist supervising the use of the machine by an individual being exercised.

Modifications may be made within the scope of the appended claims.

What is claimed is:

1. In an exercising apparatus; a frame, including a base and a column, support means for supporting a seat on the column, an upright portion on the frame forwardly of said column having foot pedals independently rotatable thereon near the bottom and hand graspable crank arms independently rotatable thereon near the top, first drive means connecting each foot petal with the crank arm on the same side of the apparatus, a drive motor in the frame, second drive means connecting the drive motor to said foot pedals for rotation of the foot pedals at respective speeds of rotation, an energizing circuit for said motor, first means in said circuit for varying the speed of said motor, and second means in said circuit for reversing said motor.

2. An exercising apparatus according to claim 1 in which said first drive means is operable to cause each crank arm to rotate in a direction opposite to the direction of rotation of the respective foot pedal.

3. An exercising apparatus according to claim 1 in which said first drive means causes each said crank arms to rotate at a respective speed.

4. An exercising apparatus according to claim 1 in which said drive means causes said foot pedals to rotate in respective directions and at respective speeds, and said second drive means causes said crank arms to rotate in respective directions and at respective speeds, said second drive means causing each crank arm to rotate in a direction opposite to that of the respective foot pedal and at a speed different from that of the respective foot pedal.

5. An exercising apparatus according to claim 4 in which said second drive means also cause said crank arms to rotate at respective speeds.

6. An exercising apparatus according to claim 1 in which said second means in said circuit is a switch having "forward," "reverse," and "off" positions to control the energization and direction of rotation of the motor, and an "on-off" switch in the circuit positioned on the frame in front of said column so as to be readily available to an individual seated in the apparatus.

7. An exercising apparatus according to claim 1 in which the support means includes a rod element telescopically engaging said column from above, means for supporting said rod element in vertically adjusted positions on said column, and a cross bar on the upper end of said rod element having means for receiving a seat in adjusted positions therealong.

8. An exercising apparatus according to claim 7 in which said column and rod element are noncircular in cross section and said cross bar is connected to said rod element near one end of the cross bar.

9. An exercising apparatus according to claim 1 in which said second drive means includes driving sprockets on the motor, driven sprockets on the foot pedals, and chains interconnecting the sprockets, and an idler sprocket on the opposite side of one driving sprocket from the respective driven sprocket, the chain for said one driving sprocket being entrained about the respective driven sprocket and said idler sprocket and having the outer side drivingly engaging said one driving sprocket.

10. An exercising apparatus according to claim 9 which includes means movably supporting said idler sprocket, said idler sprocket in one position supporting the chain with the outer side engaging the respective driving sprocket and in another position supporting the same said chain with the inner side engaging the respective driving sprocket.

11. An exercising apparatus according to claim 10 in which said means supporting said idler sprocket comprises an arm pivotally supported at one end and having said idler sprocket rotatable thereon at the other end.

12. An exercising apparatus according to claim 1 in which said first drive means includes a first sprocket on each foot pedal and a second sprocket on each crank arm and chains connecting each first sprocket with the respective second sprocket, idler sprocket means supported beneath each first sprocket, each chain for said first sprockets being entrained about the respective second sprocket and the respective idler sprocket means and having the outer side drivingly engaging the respective first sprocket.

13. An exercising apparatus according to claim 1 in which said second drive means includes driving sprockets on the motor, driven sprockets on the foot pedals, and chains interconnecting the sprockets, and an idler sprocket on the opposite side of one driving sprocket from the respective driven sprocket, the chain for said one driving sprocket being entrained about the respective driven sprocket and said idler sprocket and having the outer side drivingly engaging said one driving sprocket, said first drive means including a first sprocket on each foot pedal and a second sprocket on each crank arm and chains connecting each first sprocket with the respective second sprocket, idler sprocket means supported beneath each first sprocket, each chain for a first sprockets being entrained about the respective second sprocket and the respective idler sprocket means and having the outer side drivingly engaging the respective first sprocket.

14. An exercising apparatus according to claim 1 in which said apparatus includes a control box at the upper end of said upright portion, said first and second means being mounted on one side of said box, said box being movably supported at the upper end of said upright portion and being movable thereon between one position in which said one side faces an individual seated in the apparatus and another position in which said one side faces away from the individual.

15. An exercising apparatus comprising:

a. a support frame having a vertically projected portion and a weight-supporting portion with the latter adapted for receiving an occupant in seated position thereon for exercising operation;

b. two foot pedal members each having a force transmitting connection which effects rotation of its respective foot pedal in a respective direction and imparting thereto a respective angular speed whereby the foot pedals are positioned at successively different relative angular positions during rotation thereof;

c. power means for effecting rotation of said foot pedals;

d. two crank arms one adapted to be grasped by each arm of the occupant;

e. force transmitting connections between said foot pedals and crank arms to effect rotation of said crank arms at relatively different angular speeds and driving each crank arm in a direction opposite to that of the respective foot pedal and at a different speed whereby the crank arms assume successively different angular positions during rotation and both the arms and legs of the occupant are subjected to constant change while they are turned from operative combinations with the foot pedals and crank arms respectively.

16. An exercising apparatus comprising the combination of:

a. a support frame having a portion adapted for seating a person thereon;

b. means for mounting a pair of foot pedals at the base of said frame;

c. motor means for effecting rotation of said foot pedals on a common axis;

d. transmission means operatively connected to said motor means and said foot pedals for providing differential angular movement of said foot pedals on said axis in respective directions of rotation whereby the relative foot and leg positions are varied constantly in relative angular positions during the respective rotational movement of said pedals thereby effecting exercising movements and change in relative positions of the legs of the person contacting said pedals; and e. selectively actuatable means for reversing said motor means.

* * * * *

UNITED STATES PATENT OFFICE

CERTIFICATE OF CORRECTION

PATENT NO. : 3,991,749

DATED : Nov. 16, 1976

INVENTOR(S) : Lawson J. Zent

It is certified that error appears in the above-identified patent and that said Letters Patent are hereby corrected as shown below:

Col. 1, line 9, "set" should be -- seat --.

Col. 1, line 60 "portion" omitted between "upright and "near"

Col. 5, line 10, "and" omitted between "on-off" and "reversing"

Col. 5, line 21, "to" should be omitted between "and" and "be".

Col. 5, line 40, "petal" should be -- pedal -- (Claim 1)

Col. 5, line 55, "second" omitted between "said" and "drive" (Claim 4)

Col. 6, line 61, "for a first" should be -- for said first -- (Claim 13)

Signed and Sealed this

Twelfth Day of April 1977

[SEAL]

*Attest:*

RUTH C. MASON
*Attesting Officer*

C. MARSHALL DANN
*Commissioner of Patents and Trademarks*